US008632640B2

(12) United States Patent
Cetinkaya et al.

(10) Patent No.: US 8,632,640 B2
(45) Date of Patent: Jan. 21, 2014

(54) DISHWASHER

(75) Inventors: Ebru Cetinkaya, Istanbul (TR); Yahya Kose, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 700 days.

(21) Appl. No.: 12/990,781

(22) PCT Filed: Apr. 10, 2009

(86) PCT No.: PCT/EP2009/054355

§ 371 (c)(1),
(2), (4) Date: Nov. 2, 2010

(87) PCT Pub. No.: WO2009/132953

PCT Pub. Date: Nov. 5, 2009

(65) Prior Publication Data

US 2011/0048477 A1 Mar. 3, 2011

(30) Foreign Application Priority Data

May 2, 2008 (TR) ..... A 2008/03081

(51) Int. Cl.
*B08B 3/00* (2006.01)

(52) U.S. Cl.
USPC ..... 134/58 D; 134/18; 134/56 R; 134/115 R; 134/113; 68/5 R; 68/12.01; 68/13 R; 68/28; 700/11; 700/28; 700/83; 700/275

(58) Field of Classification Search
USPC ..... 134/18, 56 R, 57 R, 57 D, 57 DL, 58 R, 134/58 D, 58 DL, 113, 200, 115 R, 172, 34, 134/94.1; 68/5 R, 12.01, 12.26, 13 R, 27, 28; 700/11, 28, 67, 83, 275
See application file for complete search history.

(56) References Cited

U.S. PATENT DOCUMENTS

2008/0276965 A1* 11/2008 Aykroyd et al. ..... 134/18

FOREIGN PATENT DOCUMENTS

| | | | | |
|---|---|---|---|---|
| CH | 691344 A5 | | 7/2001 | |
| EP | 0123099 A | | 10/1984 | |
| EP | 0 123 099 | * | 12/1984 | ..... G05B 19/12 |

OTHER PUBLICATIONS

Gav et al., Machine Translation: Dishwashing machine or washing and/or drying appliance has control unit operating panel provided with main program selection button and auxilary selection buttons for program variants, Jul. 2001.*

International Search Report, mailing date Jul. 24, 2009, for corresponding International Application No. PCT/EP2009/054355.

* cited by examiner

*Primary Examiner* — Michael Barr
*Assistant Examiner* — Thomas Bucci
(74) *Attorney, Agent, or Firm* — Venable, Campillo, Logan & Meaney PC

(57) ABSTRACT

The present invention relates to a dish-washer (1) having a single push-button (3) which is utilized by the user to select all of the programs.

9 Claims, 1 Drawing Sheet

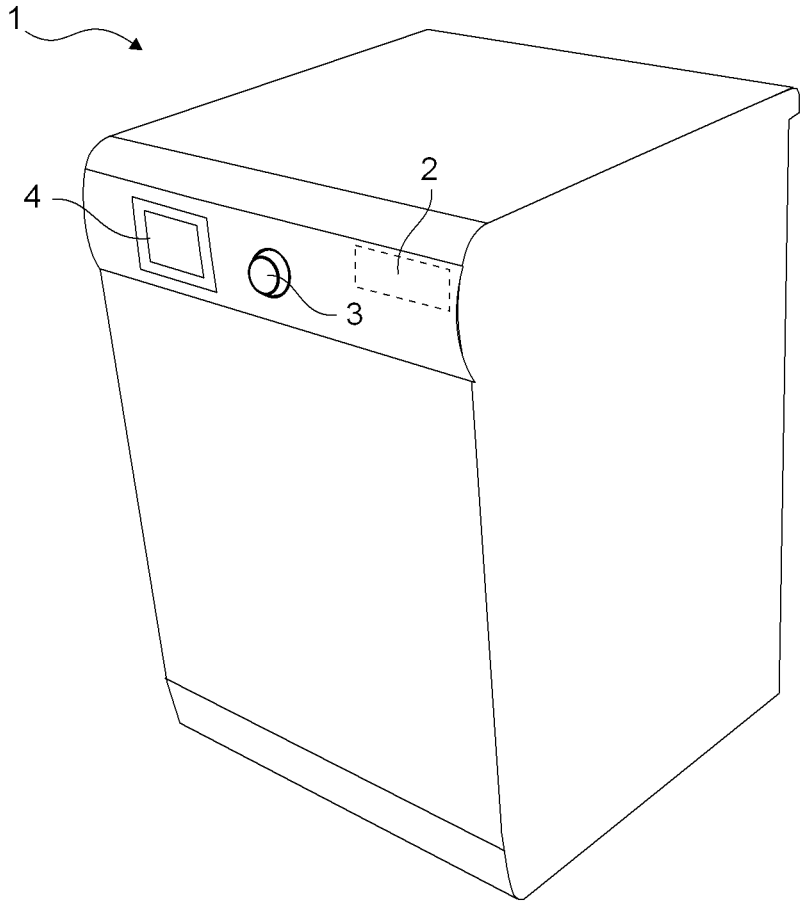
1
2
3
4

DISHWASHER

CROSS-REFERENCE TO RELATED APPLICATIONS

This application is a U.S. National Phase application, under 35 U.S.C. §371, of International Application no. PCT/EP2009/054355, with an international filing date of Apr. 10, 2009 and claims benefit of Turkish Application no. 2008/03081 filed on May 2, 2008, and which are hereby incorporated by reference for all purposes.

The present invention relates to a single push-button dishwasher.

In single push-button dishwashers, the washing program is operated without the control of the user. In this type of machines, elements such as the amount of dishes, the dirt level of the dishes, temperature and hardness of the washing water are detected by various sensors and the washing program is performed by automatic selection without any intervention by the user. Therefore, the intervention of the user is limited in single push-button dishwashers, one of the functions the user is allowed to intervene is the program cancellation function that cancels the present washing program. However, a push-button lock function is provided that is activated at the end of a certain time after the dishwasher starts operating for certain security reasons to prevent accidental intervention of the buttons. In case any push-button is pressed, the function assigned to that push-button cannot be performed when the push-button lock is activated.

The aim of the present invention is the realization of a dishwasher wherein releasing of the push-button lock and cancelling the program is performed by a single push-button.

The single push-button dishwasher realized in order to attain the aim of the present invention, explicated in the first claim and the respective claims thereof, comprises a control card that maintains the push-button lock to be released by pressing on the push-button as long as the releasing duration determined by the producer while the push-button lock is activated and cancels the program when the push-button is pressed as long as the cancelling duration determined by the producer before the push-button lock is automatically reactivated.

Accordingly, in a single push-button dishwasher, two different functions such as releasing the push-button lock and cancelling the program can be controlled by the durations of pressing on the push-button.

In an embodiment of the present invention, the releasing duration required for pressing on the push-button to release the push-button lock and the cancelling duration required for pressing on the push-button to cancel the program are equal.

In another embodiment of the present invention, the releasing duration required for pressing on the push-button to release the push-button lock and the cancelling duration required for pressing on the push-button to cancel the program are different from each other.

In another embodiment of the present invention, the dishwasher comprises a display that indicates for how much longer the user needs to press on the push-button so that a function can be activated. Thus, the user is informed by the display, for how long the user has to press on the push-button so that the function to be performed at the moment the user presses on the push-button will be activated or deactivated.

In this embodiment of the present invention, the display indicates for the user the remaining time necessary for pressing on the push-button.

By means of the present invention, in a single push-button dishwasher, activation and deactivation of two different functions can be controlled by the user with the durations of pressing on the push-button.

A dishwasher realized in order to attain the aim of the present invention is illustrated in the attached figures, where:

FIG. 1—is the perspective view of a single push-button dishwasher.

The elements illustrated in the figures are numbered as follows:

1. Dishwasher
2. Control card
3. Push-button
4. Display

The dishwasher (1) of the present invention has only a single push-button (3) for the user to select all of the programs and comprises a control card (2) (FIG. 1).

The control card (2) locks the push-button (3) if the push-button (3) is not pressed within a locking duration (T1) determined by the producer after the program is started, releases the push-button lock when the push-button (3) is pressed on by the user as long as a releasing duration (T2) determined by the producer and cancels the program when the push-button (3) is pressed on as long as a cancelling duration (T3) determined by the producer before the push-button lock is reactivated.

After the dishwasher (1) is started by pressing on the push-button (3), the bush-button lock is activated within the locking duration (T1) determined by the producer. In case the push-button (3) is pressed while the push-button lock is active, the push-button (3) does not perform the function assigned thereto. If the user wants to cancel the program for any reason while the push-button lock is active, the following course is pursued in the single push-button dishwasher (1) of the present invention:

The user unlocks the push-button lock by pressing on the push-button (3) for as long as the releasing duration (T2) determined by the producer. After the push-button lock is released, if the push-button (3) is not pressed again then the push-button lock is activated. Therefore, the user has to press on the push-button (3) again before the locking duration (T1) is completed so that the push-button lock is not reactivated. The user presses on the push-button (3) again before the push-button lock is activated. When the user presses on the push-button (3) as long as the cancelling duration (T3) determined by the producer, the program is cancelled and the ongoing program of the dishwasher (1) is terminated by the user.

Accordingly, in a single push-button dishwasher (1), it is possible to both deactivate the push-button lock and also to cancel the program by a single push-button (3) by controlling the time durations of pressing on the push-button (3).

In an embodiment of the present invention, the cancelling duration (T3) required for the user to press on the push-button (3) for cancelling the program is equal to the releasing duration (T2) required for the user to press on the push-button (3) for releasing the push-button lock.

In another embodiment of the present invention, the cancelling duration (T3) is different from the releasing duration (T2).

In another embodiment of the present invention, the dishwasher (1) comprises a display (4) that indicates for how much longer the user needs to press on the push-button (3) by showing the user the duration the push-button (3) is pressed on by the user. The display (4) is activated when the user presses on the push-button (3) and shows the user for how much longer the user has to press on the push-button (3) so that the implementation of the function is activated or deactivated. Thus, when the user presses on the push-button (3), s/he is informed by the display (4) about the time period after which a specific function will be activated or deactivated.

In this embodiment of the present invention, the control card (2) indicates for the user the remaining time necessary for pressing on the push-button (3).

In a model implementation for deactivating the push-button lock, the display (4) indicates the following inscriptions from the moment the push-button (3) is pressed:

"release the push-button lock 5"
"release the push-button lock 4"
"release the push-button lock 3"
"release the push-button lock 2"
"release the push-button lock 1" and
"the push-button lock is released".

Accordingly the user can follow from the display (4) for how much longer s/he has to press on the push-button (3) for the push-button lock to be deactivated from the moment of first pressing on the push-button (3).

In another example for activating the program cancelling function, the display (4) indicates the following inscriptions from the moment the push-button (3) is pressed:

"program cancellation 5"
"program cancellation 4"
"program cancellation 3"
"program cancellation 2"
"program cancellation 1" and
"program is cancelled.

Accordingly, the user can follow from the display (4) for how much longer s/he has to press on the push-button (3) for the program to be cancelled from the moment of first pressing on the push-button (3).

By means of the present invention, in a dishwasher (1) having a single push-button (3) thereon, the user can open the push-button lock and cancel the program by using the time durations of pressing on the push-button (3).

The invention claimed is:

1. A dishwasher that comprises a single push-button which is utilized in selecting all of a plurality of programs by a user and a control card, and characterized by the control card that locks a push-button if the push-button is not pressed within a locking duration (T1) determined by a producer after a program is started, releases the push-button lock when the push-button is pressed on by the user as long as a releasing duration (T2) determined by the producer, and cancels the program when the push-button is pressed on for as long as a cancelling duration (T3) determined by the producer before the push-button lock is reactivated.

2. A dishwasher as in claim 1, characterized by the cancelling duration (T3) being equal to the releasing duration (T2).

3. A dishwasher as in claim 1, characterized by the cancelling duration (T3) being different from the releasing duration (12).

4. A dishwasher as in claim 1, characterized by a display that is activated when the user presses on the push-button and indicates for how much longer the user needs to press on the push-button by showing the user a time duration the push-button is pressed on by the user.

5. A dishwasher as in claim 2, characterized by a display that is activated when the user presses on the push-button and indicates for how much longer the user needs to press on the push-button by showing the user a time duration the push-button is pressed on by the user.

6. A dishwasher as in claim 3, characterized by a display that is activated when the user presses on the push-button and indicates for how much longer the user needs to press on the push-button by showing the user a time duration the push-button is pressed on by the user.

7. A dishwasher as in claim 4, characterized by a display that shows the user pressing on the push-button a remaining time for releasing the push-button lock or cancelling the program.

8. A dishwasher as in claim 5, characterized by a display that shows the user pressing on the push-button a remaining time for releasing the push-button lock or cancelling the program.

9. A dishwasher as in claim 6, characterized by a display that shows the user pressing on the push-button a remaining time for releasing the push-button lock or cancelling the program.

* * * * *